US006463753B1

(12) United States Patent
Haskayne

(10) Patent No.: US 6,463,753 B1
(45) Date of Patent: Oct. 15, 2002

(54) ARRANGEMENT FOR BEVERAGE DISPENSER CARBONATION

(75) Inventor: Paul Haskayne, Adelaide (AU)

(73) Assignee: Lancer Partnership L.L.P., San Antonio, TX (US)

( * ) Notice: Subject to any disclaimer, the term of this patent is extended or adjusted under 35 U.S.C. 154(b) by 0 days.

(21) Appl. No.: 09/850,423

(22) Filed: May 7, 2001

(51) Int. Cl.[7] ..... B67D 5/62
(52) U.S. Cl. ..... 62/389; 62/393; 222/146.6
(58) Field of Search ..... 62/390, 389, 391, 62/393, 396, 331; 222/146.6, 129.1, 129.3

(56) References Cited

U.S. PATENT DOCUMENTS 5,249,710 A * 10/1993 Hassell et al. ..... 222/146.6
5,487,492 A * 1/1996 Goulet ..... 222/129.1
5,524,452 A * 6/1996 Hassell et al. ..... 62/389
6,045,007 A * 4/2000 Simmons ..... 222/146.6
6,155,069 A * 12/2000 Quartatone et al. ..... 62/344

* cited by examiner

*Primary Examiner*—Chen-Wen Jiang
(74) *Attorney, Agent, or Firm*—Christopher L. Makay

(57) ABSTRACT

An arrangement for a beverage dispenser carbonation unit generally comprises a two-part cold plate for cooling fluids. The first part is cooled by ice contained within an adjacent ice bin. The second part is cooled by proximity to the ice within the ice bin as well as a fluid conveyed through the first part and then the second part. The second part of the cold plate comprises a sleeve, preferably integral therewith, for receiving a carbonator unit and maintaining the carbonator unit at a reduced temperature. A re-circulation pump is provided for conveyance of the fluid between the two parts of the cold plate.

34 Claims, 3 Drawing Sheets

ARRANGEMENT FOR BEVERAGE DISPENSER CARBONATION

FIELD OF THE INVENTION

The present invention relates to beverage dispensers. More particularly, the invention relates to a beverage dispenser including a carbonator unit arranged within the beverage dispenser in a manner to (1) promote efficient carbonation of water, (2) produce chilled carbonated water and (3) maintain the sanitary integrity of the beverage dispenser.

BACKGROUND OF THE INVENTION

Efficient carbonation is known to be a function of both temperature and pressure. While it is possible at room temperature to introduce carbon dioxide ($CO_2$) into water for the production of carbonated water, it is more efficient to perform the carbonation process at a reduced temperature. Additionally, because the produced carbonated water is generally obtained for use in the preparation of a post-mix beverage, it is desirable that the resultant carbonated water be produced at a reduced temperature in order to ensure that its temperature may be as low as possible at the time of beverage mixing. To this end, others have proposed beverage dispensers wherein a carbonator unit is associated with the ice bin of the beverage dispenser.

Unfortunately, previous designs incorporating such a feature have generally neglected the necessity for maintaining the ice bin in a sterile environment. Because it is critical that ice within the ice bin not be contaminated in the course of maintaining the carbonator unit, Applicant has discovered that it is difficult to utilize the ice bin for cooling of the carbonator unit. For these reasons, it is an overriding object of the present invention to improve over the prior art by providing a beverage dispenser having incorporated therein a carbonator unit that is able to take advantage of the ice bin for reduced temperature carbonation of water without risk of contamination of ice within the ice bin.

It is a further object of the present invention to provide such a beverage dispenser wherein the carbonator unit is readily accessible for periodic maintenance and/or repair. Finally, it is an object of the present invention to provide such a beverage dispenser wherein the carbonated water produced by the carbonator unit is maintained at a very low temperature for preparation of a beverage.

SUMMARY OF THE INVENTION

In accordance with the foregoing objects, the present invention—an arrangement for a beverage dispenser carbonation unit—generally comprises a two-part cold plate for cooling fluids, wherein the first part is cooled by ice contained within an adjacent ice bin. The second part is cooled by proximity to the ice within the ice bin as well as a fluid conveyed through the first part and then the second part. The second part of the cold plate comprises a sleeve, preferably integral therewith, for receiving a carbonator unit and maintaining the carbonator unit at a reduced temperature. A re-circulation pump is provided for conveyance of the fluid between the two parts of the cold plate.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Figure 1:
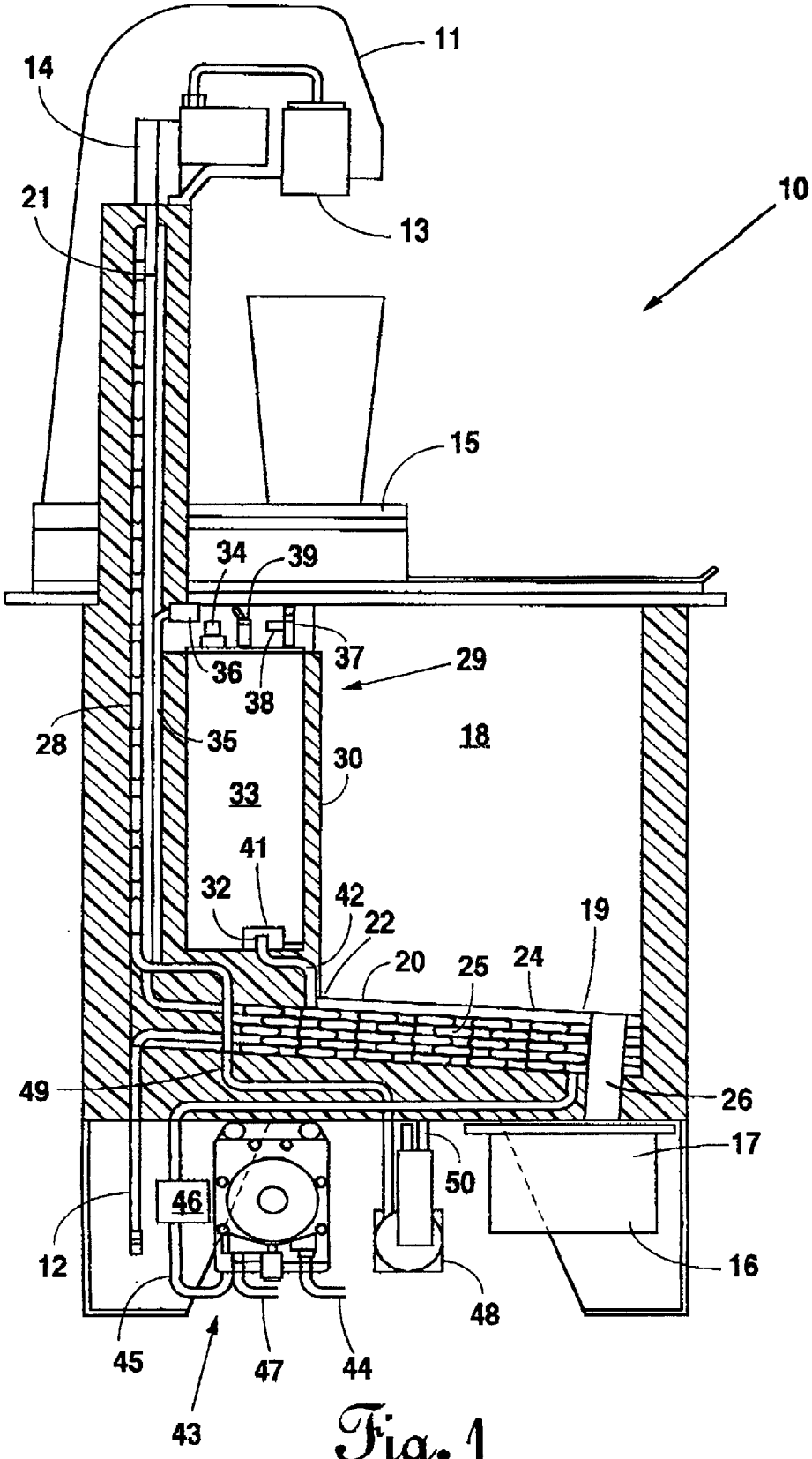
FIG. 1 shows, in partial cut-away side elevational view taken along line 1—1 of FIG. 2, a beverage dispenser incorporating the arrangement for improved carbonation of the present invention.

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Referring now to the figures, a carbonator cold housing 29 is shown to be arranged integral with a substantially vertical extended cold plate 27, which is preferably integral with a substantially horizontal cold plate 19. In the preferred embodiment of the present invention, the cold plate 19 forms the base of an ice bin 18 for an otherwise conventional beverage dispenser 10 while the extended cold plate 27 and carbonator cold housing 29 cooperate to form the back wall of the ice bin 18. As shown in the figures, the carbonator cold housing 29 comprises a carbonator sleeve 30 for receiving therein a carbonator unit 33. As will be better understood further herein, the arrangement of the present invention is specifically adapted to enable carbonation of water at an efficiently low temperature while also taking care to ensure maintenance of a sanitary environment within the ice bin 18.

As particularly shown in FIG. 1, the beverage dispenser 10 with which the present invention is implemented generally comprises a conventional flavor selection keypad 11 for controlling, through a plurality of flow control valves 14, flow of one or more beverage's constituent components to one or more dispensing nozzles 13, which may be multi-flavor mixing nozzles, LEV's, volumetric dispensing valves, and the like. As will be appreciated by those of ordinary skill in the art, the constituent components for a beverage generally comprise syrups, conveyed to the beverage dispenser 10 through a plurality of syrups inlet lines 12 and to the flow control valves 14 through chilled syrup lines 21, and carbonated water, conveyed to the flow control valves 14 through chilled carbonated water lines 23. Likewise, the beverage dispenser 10 to also comprises a removable drip tray 15 as well as a power transformer 16 and a carbonator control module 17, each of which is similar to others known in the art. As will be better understood further herein, however, these and other components of the beverage dispenser 10 are specifically arranged in the present invention to enhance carbonation of the water used in the preparation of a beverage by ensuring that the entire carbonation process be accomplished at a reduced temperature.

Figure 2:
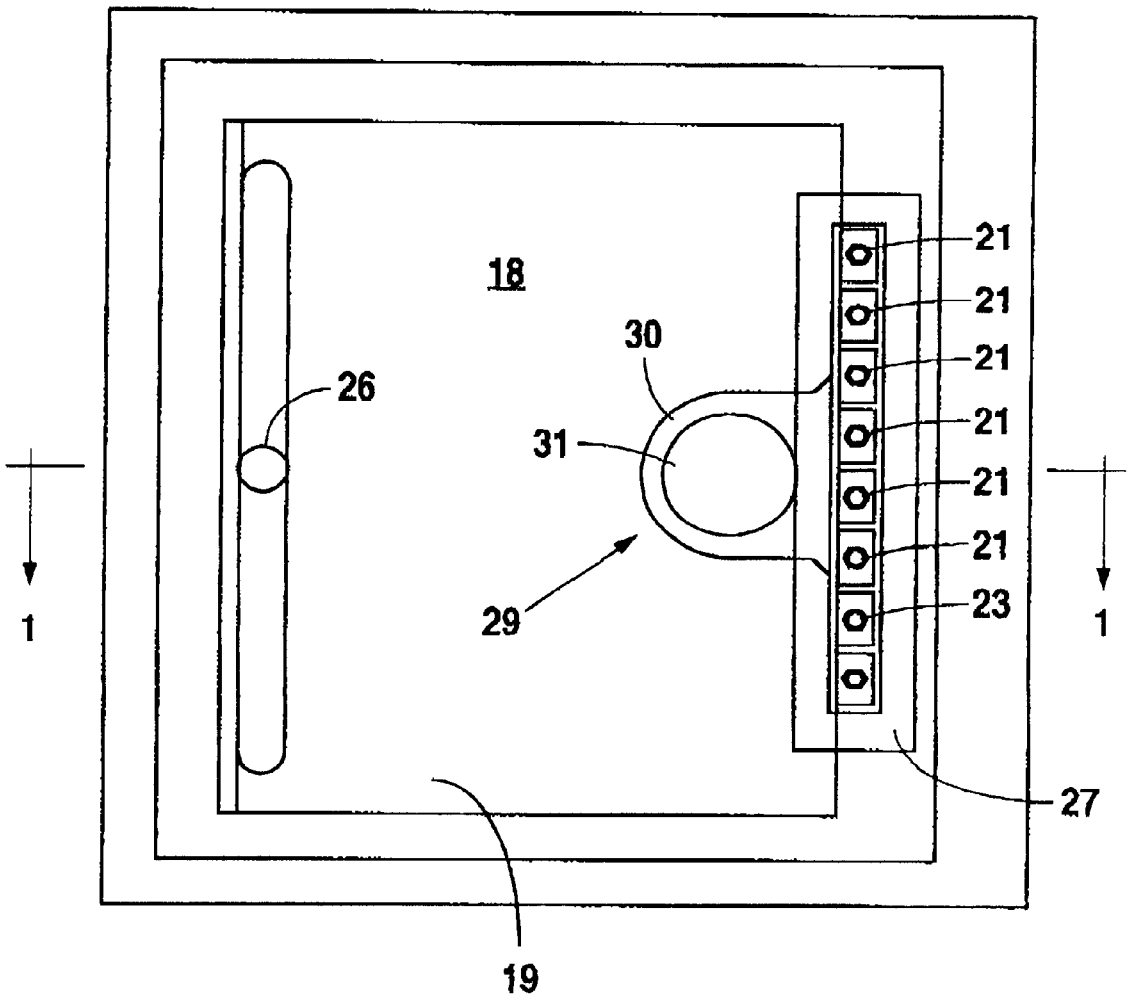
FIG. 2 shows, in a top plan view, certain details of the arrangement of the present invention.
Figure 3:
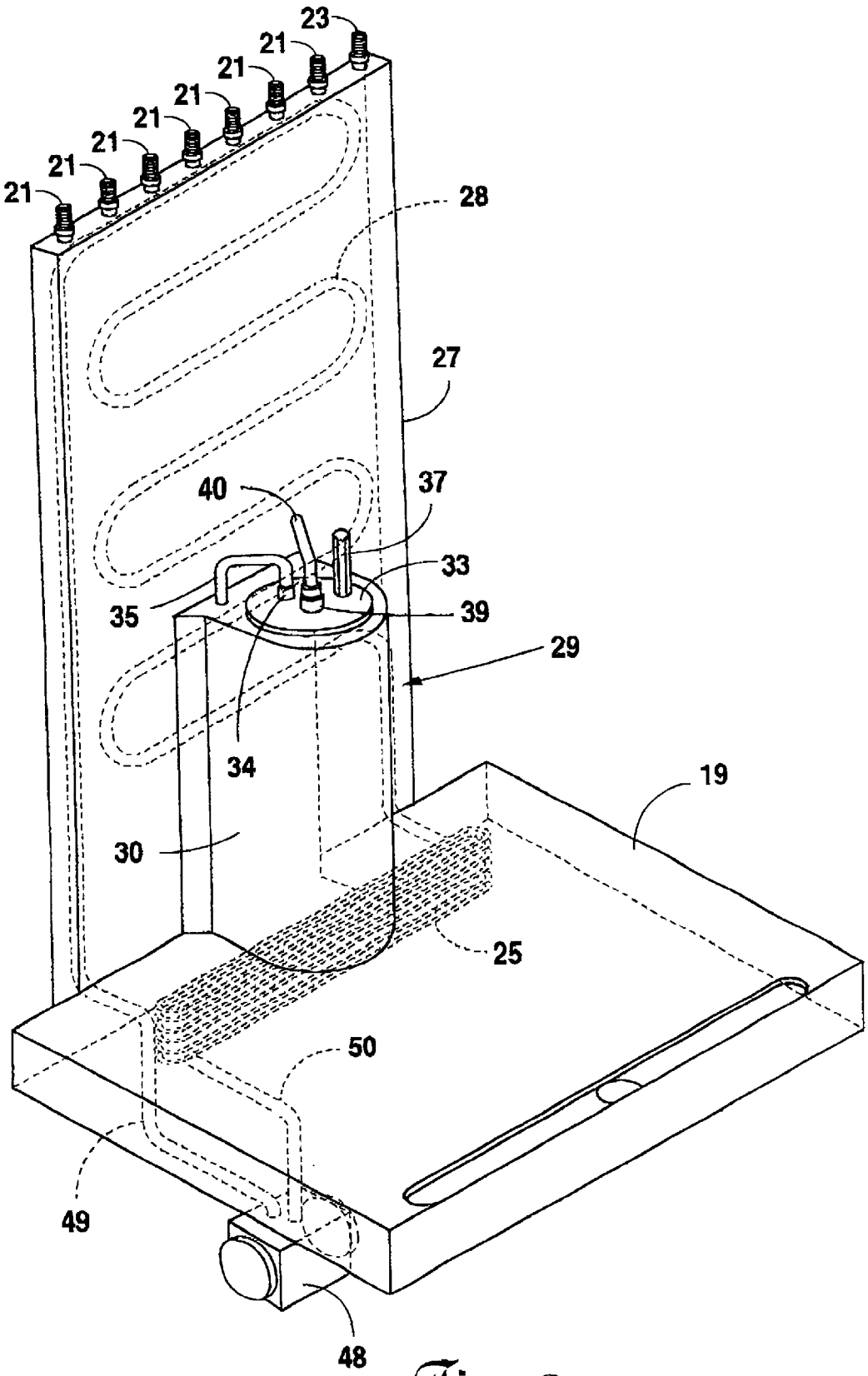
FIG. 3 shows, in a perspective view, details additional details of one implementation of the arrangement of the present invention.

As shown in FIGS. 2 and 3, a cold fluid re-circulation system is implemented within the arrangement of the carbonator cold housing 29 and the vertical extended cold plate 27 in order to ensure that the syrup lines 21 and the carbonated water lines 23, which may be cast within the vertical extended cold plate 27, are maintained at a reduced temperature. In particular, the cold fluid re-circulation system comprises a cold fluid re-circulation line 28, embedded within the extended cold plate 27; a re-circulation fluid chilling coil 25, embedded within the cold plate 19; and a cold fluid re-circulation pump [4]8 for circulating a fluid, preferably soda water, between the re-circulation fluid chilling coil 25 and cold fluid re-circulation line 28. As particularly shown in FIG. 3, the cold fluid re-circulation line 28 preferably terminates into a cold fluid re-circulation return line 49 leading to the cold fluid re-circulation pump 48. Likewise fluid pumped from the cold fluid re-circulation pump 48 preferably passes through a cold fluid re-circulation output line 50 toward the re-circulation fluid chilling coil 25. In this manner, as will be appreciated by those of ordinary skill in the art, fluid in the re-circulation fluid chilling coil 25 is cooled by the cold plate 19 and then passed directly to the cold fluid re-circulation line 28, where the cooled fluid serves to cool the extended cold plate 27 and thus the syrup lines 21 and the carbonated water lines 23.

The carbonator sleeve 30 preferably protrudes into the ice bin 18 for cooling of the carbonator cold housing 29 when sufficient quantities of ice are present within the ice bin 18. The carbonator unit 33, which may be cast within the carbonator sleeve 30 or removable through an opening 31 in an upper portion of the carbonator sleeve 30, is thus maintained at a reduced temperature. This arrangement accordingly serves to ensure that carbonation of water within the carbonator unit 33 takes place at a low temperature. As will be appreciated by those of ordinary skill in the art, however, the cold fluid re-circulation system as previously described serves to impart cooling upon the carbonator cold housing 29 even when very low levels of ice are present within the ice bin 18. It is noted that while the carbonator sleeve 30 protrudes into the ice bin 18, the opening 31 for insertion or removal of, or access to, the carbonator unit 33 is at a level above the maximum level of ice in the ice bin 18. In this manner, the arrangement of the present invention is specifically adapted to prevent contamination of ice contained within the ice bin 18. Consistent with this arrangement, access to the carbonator unit 33 is preferably limited to access through the removal drip tray 15, as particularly shown in FIG. 1.

In order to further ensure efficient carbonation within the carbonator unit 33, both the water and $CO_2$ delivered thereto are preferably first chilled. In particular, as shown in FIG. 1, a water pre-chilling coil 24 is provided within the cold plate 19 for pre-chilling of water to be delivered to the carbonator unit 33 through a pre-chilled water inlet line 35, which terminates at a pre-chilled inlet 34 on the carbonator unit 33. Because it is contemplated that the carbonator unit 33 may be removable though the opening 31 at the upper portion of the carbonator sleeve 30, it is preferred that the pre-chilled inlet line 35 be embedded within the extended cold plate 27 and surface from the extended cold plate 27 in the region of the opening 31. Likewise, safety devices, such as a double back-check valve 36 provided in the pre-chilled water inlet line 35, are also located in the readily accessible region of the opening 31. For the same reasons, the preferred embodiment of the present invention contemplates utilization of a carbonator unit 33 having a level probe 37 and a relief valve 38 at an upper portion of the carbonator unit 33 in order that these devices may be readily accessed through the removal drip tray 15—with or without ice in the ice bin 18 and without concern for contamination of any ice in the ice bin 18. Pressurized $CO_2$ is delivered from a regulated $CO_2$ source to a $CO_2$ inlet 39—also at the upper portion of the carbonator unit 33—through a pressurized $CO_2$ inlet line 40. As will be appreciated by those of ordinary skill in the art, the pressurized $CO_2$ inlet line 40 may also be passed through the cold plate 19 and/or extended cold plate 27 for pre-chilling of the $CO_2$ passed therethrough.

A carbonated water outlet port 32 is provided for convenience of carbonated water from the carbonator unit 33 to a carbonated water outlet line 42. As particularly shown in Figure one, the carbonated water outlet port 32 is preferably formed in the base of the carbonator sleeve 30 for substantially direct convenience of carbonated water from a carbonated water outlet 41 to a carbonated water cooling coil 22 located within the cold plate 19. In this manner carbonation of the water is effectively maintained in route the dispensing nozzle(s) 13 though the chilled carbonated water lines 23. Additionally, because most beverages will comprise a high ratio of carbonated water to syrup products, it is desirable to maintain the carbonated water at a very low temperature in order to deliver to the consumer a refreshingly cool drink. To this end, a plurality of syrup cooling coils 20 are also preferably provided intermediate the syrup inlet lines 12 and the chilled syrup lines 21.

In operation, preferably a $CO_2$ gas operated carbonator pump 43 is provided for conveying water from a water inlet line 44 through a water outlet line 45 and water pre-chilling coil 24 to the carbonator unit 33. A solenoid valve 46 is preferably provided in the water outlet line 45 to control flow through the water pre-chilling coil 24 and pre-chilled water inlet line 35 to the carbonator unit 33 according to indications from the level probe 37 as conventional in the art. A $CO_2$ source line 47 is also preferably provided for connection of the carbonator pump 43 to the source of regulated $CO_2$ unutilized in the carbonation process. While the carbonator pump 43 is only operated when the carbonator unit 33 requires additional pre-chilled water, it is noted that the cold fluid re-circulation pump 48 operates continuously. For this reason, it is preferred that the cold fluid re-circulation pump 48 be electrically operated in order to conserve $CO_2$ gas although those of ordinary skill in the art will recognize that the cold liquid re-circulation pump 48 could otherwise be operated.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, it is noted that the placement of the cold fluid re-circulation pump 48 as shown in FIG. 3 differs from that shown in FIG. 1. As shown in FIG. 3, the cold fluid re-circulation pump 48 may be desirably positioned near an edge of the cold plate 19 in order to facilitate access for regular maintenance repair.

Additionally, it should be noted that many features common to beverage dispensers have not been specifically discussed in order to preserve clarity. For example, the ice bin 18 is provided with an ice bin drain 26. These and other features, not directly necessary to the understanding of the present invention, have been omitted. In any case, because the scope of the present invention is much broader than any particular embodiment, the foregoing detailed description should not be construed as a limitation of the scope of the present invention, which is limited only by the claims appended hereto.

What is claimed is:

1. An arrangement for a beverage dispenser carbonator system, said arrangement comprising:

a cold plate for cooling fluids, said cold plate having a substantially horizontal portion and a substantially vertical portion; and a sleeve adjacent said vertical portion, said sleeve being adapted to receive therein a carbonator unit.

2. The arrangement as recited in claim 1, wherein said horizontal portion at least partially forms the base of a beverage dispenser ice bin.

3. The arrangement as recited in claim 1, wherein said vertical portion at least partially forms one side of said beverage dispenser ice bin.

4. The arrangement as recited in claim 3, wherein said sleeve at least partially forms said one side of said beverage dispenser ice bin.

5. The arrangement as recited in claim 1, wherein said sleeve protrudes into said beverage dispenser ice bin.

6. The arrangement as recited in claim 1, wherein said sleeve is integral with said substantially vertical portion.

7. The arrangement as recited in claim 1, wherein said sleeve and said vertical portion are cast as a single structure.

8. The arrangement as recited in claim 1, wherein said substantially vertical portion is integral with said substantially horizontal portion.

9. The arrangement as recited in claim 1, wherein said substantially vertical portion and said substantially horizontal portion are cast as a single structure.

10. The arrangement as recited in claim 1, further comprising:

an elongate fluid passage, said fluid passage comprising a first section through said horizontal portion and a second section through said vertical portion; and a pump, said pump being adapted to circulate a fluid, through said fluid passage, between said first section and said second section.

11. The arrangement as recited in claim 10, wherein said first section of said fluid passage comprises a conduit.

12. The arrangement as recited in claim 11, wherein said conduit comprises a coil.

13. The arrangement as recited in claim 10, wherein said substantially horizontal portion is cast about said first section of said fluid passage.

14. The arrangement as recited in claim 10, wherein said second section comprises a conduit.

15. The arrangement as recited in claim 10, wherein said substantially vertical portion is cast about said second section of said fluid passage.

16. The arrangement as recited in claim 10, wherein said fluid passage and said pump form a substantially closed system for circulation of said fluid.

17. The arrangement as recited in claim 16, wherein circulation of said fluid through said substantially closed system follows the order of said pump to said first section to said second section to said pump.

18. The arrangement as recited in claim 10, wherein said pump comprises an electrically operated pump.

19. The arrangement as recited in claim 1, wherein said sleeve comprises an opening at an upper end thereof, said opening being adapted for insertion and removal therethrough of a carbonator unit.

20. The arrangement as recited in claim 1, wherein said sleeve comprises a port through a base portion thereof, said port being adapted to convey carbonated water from a carbonator unit within said sleeve.

21. The arrangement as recited in claim 20, wherein said port terminates into said substantially horizontal portion.

22. The arrangement as recited in claim 21, wherein the termination of said port leads to a conduit embedded within said substantially horizontal portion.

23. The arrangement as recited in claim 22, wherein said conduit passes through said substantially vertical portion for conveyance of carbonated water to a dispensing nozzle.

24. The arrangement as recited in claim 1, wherein said substantially vertical portion comprises therethrough a first conduit for conveying water to a carbonator unit within said sleeve, said first conduit having a distal end terminating in the proximity of said upper end of said sleeve.

25. The arrangement as recited in claim 24, wherein a portion of said first conduit passes through said substantially horizontal portion.

26. The arrangement as recited in claim 25, wherein said portion of said first conduit comprises a coil.

27. The arrangement as recited in claim 1, wherein said substantially vertical portion further comprises a second conduit therethrough for conveying carbon dioxide gas to a carbonator unit within said sleeve, said second tubular conduit having a distal end terminating in the proximity of said upper end of said sleeve.

28. The arrangement as recited in claim 27, wherein a portion of said second conduit passes through said substantially horizontal portion.

29. The arrangement as recited in claim 28, wherein said portion of said second conduit comprises a coil.

30. The arrangement as recited in claim 1, said arrangement further comprising a carbonator unit housed within said sleeve.

31. The arrangement as recited in claim 30, wherein said carbonator unit is fixedly cast with said sleeve.

32. The arrangement as recited in claim 1, wherein said substantially vertical portion extends between said substantially horizontal portion and an upper portion of a beverage dispenser, said upper portion comprising at least one dispensing nozzle.

33. The arrangement as recited in claim 32, wherein said substantially vertical portion comprises therethrough a syrup conduit for conveyance of a beverage product to said dispensing nozzle.

34. The arrangement as recited in claim 32, wherein said substantially vertical portion further comprises therethrough a water conduit for conveyance of chilled water to said dispensing nozzle.

* * * * *